US005694982A

United States Patent [19]

Debaes

[11] Patent Number: 5,694,982

[45] Date of Patent: Dec. 9, 1997

[54] WEFT THREAD SELECTION DEVICE

[75] Inventor: Johnny Debaes, Wenduine, Belgium

[73] Assignee: N.V. Michel Van de Wiele, Kortrijk-Marke, Belgium

[21] Appl. No.: 400,819

[22] Filed: Mar. 8, 1995

[51] Int. Cl.[6] ..... D03D 47/38

[52] U.S. Cl. ..... 139/453; 66/138

[58] Field of Search ..... 139/453; 66/138

[56] References Cited

U.S. PATENT DOCUMENTS

| | | | |
|---|---|---|---|
| 3,439,715 | 4/1969 | Juillard . | |
| 3,542,085 | 11/1970 | Haltmeler | 139/453 |
| 3,941,158 | 3/1976 | Joans . | |
| 4,541,461 | 9/1985 | Villa | 139/453 |
| 5,090,457 | 2/1992 | Corain et al. | 139/453 |

FOREIGN PATENT DOCUMENTS

| | | | |
|---|---|---|---|
| 0379703 | 8/1990 | European Pat. Off. | 139/453 |
| 1376747 | 9/1963 | France . | |
| 2502466 | 1/1975 | Germany . | |
| 2509664 | 3/1975 | Germany . | |

*Primary Examiner*—Andy Falik
*Attorney, Agent, or Firm*—James Creighton Wray

[57] ABSTRACT

A weft selection device for a weaving machine has at least two drop wires with feed-through eyes. The drop wires are fixed rotatably in two planes lying above one another to take a weft thread extending through the feed-through eye within or beyond the reach of a gripper. Each drop wire has a bent end containing the feed-through eye. The drop wires are fixed rotatably in pairs on common fixing device. The top drop wire of each pair is bent upwards and the bottom drop wire of each pair is bent downwards. A free space is provided above and below the fixing device of each pair to allow through unimpeded the weft threads. Thus, it allows for an arrangement with a minimum angle of bend of the weft threads after they have passed through the feed-through eyes. The present weft change motion is suitable for coarse and stiff yarn.

8 Claims, 2 Drawing Sheets

WEFT THREAD SELECTION DEVICE

BACKGROUND OF THE INVENTION

The invention relates to a device for the weft selection on a weaving machine. Such a device is also called a weft change motion.

More particularly, the invention relates to a weft change motion comprising at least two drop wires which are fixed rotatably in planes lying above one another, and which are provided with a bent part having a thread feed-through eye. In the operational set-up, each drop wire is rotatable by control means to a presentation position and to a retracted position. In this operational set-up a weft thread is passed through the feed-through eye of each drop wire. The abovementioned presentation position of a drop wire is the position in which the weft thread extending through the feed-through eye of said drop wire has been taken within the reach of a gripper of the weaving machine, ready for weft insertion. The abovementioned retracted position of a drop wire is the position in which the weft thread extending through the feed-through eye of said drop wire has been taken beyond the reach of a gripper of the weaving machine, and will thus not be inserted.

On a weaving machine a fabric is formed by forming a shed between the warp threads a large number of times in succession and inserting a weft thread in said shed. In the process, the warp threads and weft threads come to rest virtually at right angles to each other in the fabric and run alternately above and below one another according to a predetermined weave pattern. The various warp threads are therefore taken into a specific position during the formation of the shed, so that they are situated above or below the weft thread, according to the desired weave pattern.

The gripper of the weaving machine takes the respective weft threads—in a direction at right angles to the direction of the warp threads—into the shed, so that said weft threads extend over the full width of the fabric.

A weaving machine can be provided with one or more sets of grippers (or other devices for the insertion of weft threads).

If several sets of grippers are provided, they are disposed above one another in such a way that each gripper can insert weft threads at a different level. Such weaving machines with several grippers are used for the production of fabrics for which the insertion of weft threads at several levels is necessary, as is the case for, for example, face-to-face pile fabrics, which are produced by simultaneously weaving two ground fabrics above each other, while pile warp threads are interlaced alternately in the top and the bottom fabric, by inserting them respectively above and below a weft thread of said two fabrics. Two separate pile fabrics are obtained when the pile warp threads running from one fabric to the other are out through between the two fabrics.

Each weft thread which has to be inserted in a shed must, of course, be taken within the reach of a gripper, so that it can be carried along by said gripper.

However, it may be necessary to insert into the same fabric, at the same level, weft threads which differ from each other. Said differences may be in, for example, the colour, the thickness or the material of the yarns used.

In order to weave a particular design in a fabric, it may be necessary, for example, to insert weft threads of different colours at different points in the fabric, according to the colour of that design. It may also be necessary, for example, to insert a weft thread of different thickness or number, or also to insert a thread with S and Z twist direction.

Since weft threads have to be inserted into a shed at the same level by the same gripper, when there is a weft change a weft thread differing from the previous one therefore has to be taken within the reach of that same gripper.

In the case of weaving machines with several grippers, for example double-gripper weaving machines and three-gripper or four-gripper weaving machines, it may be necessary to do this for each gripper.

Weft thread change motions are used in order to make this changing of weft threads possible without stopping the weaving machine.

A known weft change motion for double-gripper weaving machines comprises e.g. four, six or eight flat drop wires which are disposed in such a way that they can rotate about a vertical shaft, and which at one end are provided with a feed-through eye situated in the plane of the drop wire, and at the other end are provided with a bearing point on a common through-running shaft. A weft thread extends through each feed-through eye. Each of the drop wires can be rotated about the shaft by means of an electromagnet with plunger. The weft change motion is disposed with the shaft virtually vertical in the vicinity of the grippers. Two, three or four drop wires are positioned in such a way here that they can take a weft thread within the reach of the top gripper (in the presentation position of the drop wires), while the two, three or four other drop wires are positioned in such a way that they can take a weft thread within the reach of the bottom gripper (in the presentation position of the drop wires). By rotating the drop wires, these weft threads can also be taken beyond the reach of the respective grippers (in the retracted position of the drop wires).

The operation of the weft change motion is designed in such a way that for each gripper one of the drop wires is taken into the presentation position in each case, while the other drop wire is taken into the retracted position. In this way the desired weft thread can be taken by the gripper into the shed in each case. The plunger magnets are controlled in a known manner by means which are programmable according to the required sequence of various weft threads, in order to produce the desired fabric.

Each weft thread is also passed through a guide eye, which is disposed on the weaving machine in the vicinity of the weft change motion.

For a weaving machine with three or more grippers, a weft change motion provided with e.g. two drop wires per gripper is set up in a similar way.

If more than two different weft threads have to be inserted in the same fabric at the same level, a number of drop wires corresponding to the number of different weft threads are set up, while said drop wires interact with the gripper at that level.

The set-up and operation for the rest is identical to the set-up and operation of a weft change motion with two drop wires per gripper.

These known weft change motions have the disadvantage that, after their passage through the respective feed-through eyes, the weft threads have to be bent through too great an angle in order to assume their working position relative to the weaving machine. This causes too much friction in the case of flexure-resistant yarns, with the result that the weft is pulled out of the clamping elements.

In the case of the known devices weft threads are in fact supplied from the side to the feed-through eyes, along the vertical shaft for the drop wires, so that their supply direction to the feed-through eyes differs greatly from the direction in which they have to extend after their passage through the feed-through eyes. The known devices consequently take up more space.

DE-OS-25 09 664 discloses such a weft change motion with weft-passing pins which are provided with a curved part having a feed-through eye. A weft thread extends through the feed-through eye of each weft-passing pin. The weft threads are supplied to the respective feed-through eyes next to the weft change motion by way of respective guide eyes. Before the weft threads reach the feed-through eyes, they are bent against a stop plate. Due to the fact that the point of rotation of the weft-passing pins lies completely outside the line along which the weft threads are supplied (this known weft change motion is disposed next to the weft thread supply), this device takes up a large amount of space.

Besides, in the case of this weft change motion also, the weft threads have to be bent through too great an angle after their passage through the respective feed-through eyes, in order to assume their working position relative to the weaving machine. The friction of the weft threads against the side walls of the feed-through eyes and against the stop plate is a particular disadvantage.

Furthermore, this weft change motion is also not suitable for coarse yarns, for the weft-passing pins are too weak to make coarser weft yarns deflect.

In the case of the known weft change motions, it is therefore a particular disadvantage that the weft threads, which slide through the feed-through eye at great speed when they are being inserted into the shed, rub against the side edges of the feed-through eye.

If the weft thread has laterally projecting fibres, it may also become caught up in the feed-through eye.

The abovementioned disadvantages are all the greater when coarse and relatively rigid yarns are used (for example, Jute, canvas, hemp, fibrillated polypropylene, glass fibre and carbon fibre, and yarns with a metric count ranging between 7/2 and 0.75/2), and they are the reason for the known weft change motions failing to function when such yarns are used. Due to their low flexibility, such yarns are in fact subjected to very great friction against the side edges of the feed-through eye, and they very easily become caught up, due to the projecting fibres. This friction increases as the yarns undergo a great bending in the feed-through eye.

SUMMARY OF THE INVENTION

The object of this invention is to overcome the above-described disadvantages. This object is achieved with a weft change motion according to this invention, in which the drop wires are provided in pairs on common fixing means, while the top and the bottom drop wire are bent upwards and downwards respectively, and a free space is provided above and below the abovementioned fixing means respectively, in order to allow through unimpeded the weft threads extending through the respective feed-through eyes, in the retracted position of each drop wire.

This set-up allows the weft threads to be supplied in a direction which deviates less from the direction in which they have to extend after their passage through the feed-through eyes. This device also takes up less space. The device is disposed, as it were, between the weft threads.

A weft change motion is preferably provided with a fixed guide eye for each weft thread. These fixed guide eyes according to the invention are fixed in such a way that the point of rotation of each drop wire is situated virtually on the bisector of the angle formed by the two extreme positions of a weft thread extending through the feed-through eye of said drop wire and through the corresponding fixed guide eye, while said extreme positions are obtained by placing said drop wire in the presentation position and in the retracted position respectively.

This set-up method makes it possible for the feed-through eye of the drop wire in the presentation position to lie virtually on the line from the gripper head hook to the corresponding fixed guide eye. The run-through speed of the weft thread is at the maximum in this presentation position. Since the weft thread is virtually not bent at all in this position, the friction resistance is minimal after the passage through the feed-through eye.

In the other extreme position of the drop wires, the "retracted position", the run-through speed of the weft thread is virtually zero.

Each drop wire in the presentation position and in the retracted position forms an angle which is virtually the same size on either side of said bisector. The weft thread is thus equally tensioned in those two extreme positions, and this occurs without great bending of the weft thread.

The angle of bend of the weft threads is kept to a minimum in this way, in particular if the run-through speed is the maximum.

The points of rotation of the drop wires can also be placed in such a way that during their movement to the selection position and back the weft threads cross the the axis of rotation of the drop wires. This means that the device can be of more compact construction.

Furthermore, with this set-up equal tension is obtained in the two extreme positions of the weft thread. This is an additional advantage particularly when stiff yarns are being used, since a tension compensator cannot be used efficiently on such yarns. In addition to a reduction in the friction resistance at the level of the feed-through eye and a reduction in the risk of the yarns becoming caught up, the weft change motion thus also ensures more efficient operation when stiff yarns are being used.

A preferred embodiment of the above-described weft change motion according to this invention is obtained by fixing two drop wires rotatably on the same shaft An each case, while said shaft is supported on bearings between the two legs of a U-shaped bracket.

A particularly preferred embodiment of said weft change motion is designed in such a way that of the two drop wires fixed rotatably on the same shaft the top drop wire has an end bent upwards and the bottom drop wire has an end bent downwards, while a feed-through eye is provided in each case in the bent ends concerned.

An electromagnet with plunger, of the type used in the known weft change motion for controlling the various drop wires, has the disadvantage that sufficient changing force cannot be developed with it to ensure rapid and efficient operation.

In order to overcome this problem, the weft change motion according to this invention is provided with double-acting pneumatic cylinders. These cylinders can in turn be driven by a rapid-acting compressed air valve, which in a preferred embodiment can be operated by microprocessor control or some other programmable device. Stepping motors, which impose a rotary movement on the drop wires, can also be used.

In order to limit the friction resistance to an absolute minimum at the level of the feed-through eye, a feed-through eye of ceramic material is preferably used.

The features and the advantages of this invention are further clarified by means of a detailed description of a preferred embodiment of a weft change motion according to the invention. The invention is in no way restricted to this possible embodiment by this description.

BRIEF DESCRIPTION OF THE DRAWINGS

In this description reference is made to the appended figures, in which.

DETAILED DESCRIPTION OF THE PREFERRED EMBODIMENTS

Figure 1:
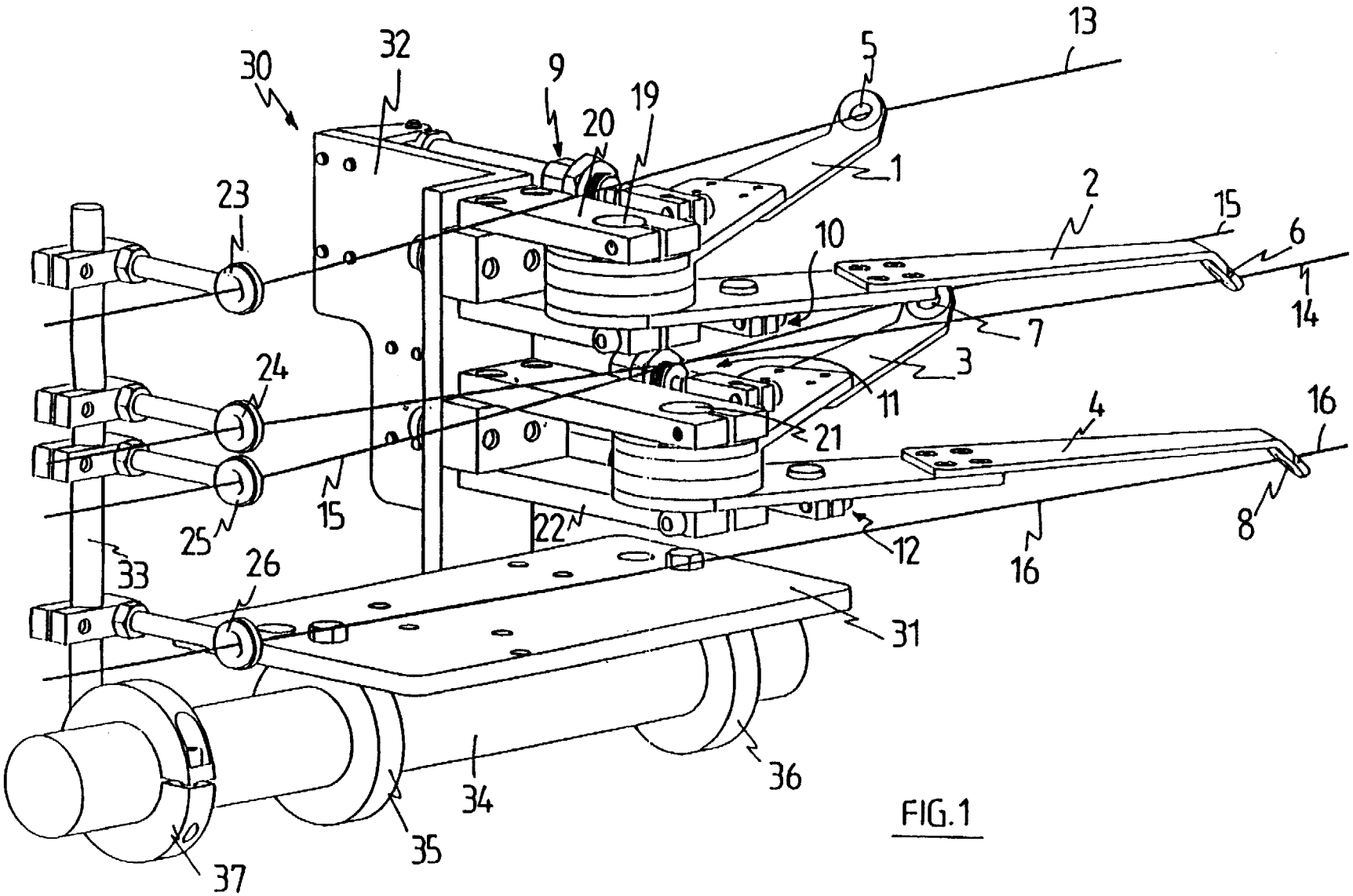
FIG. 1 shows in perspective a weft change motion for a double-gripper weaving machine, in the operational set-up.

A preferred embodiment of a weft change motion according to the invention (see FIG. 1) comprises a bearing structure (30), which is provided with means (34, 35, 36) for the fixing, which means are movable in the breadthwise direction on a fixed part of a weaving machine.

This bearing structure comprises (in the operational position) essentially a horizontal bearing plate (31) and a fixing section (32) which is situated virtually at right angles to the top surface of said bearing plate (31).

Two U-shaped brackets (20), (22) are fixed above one another on the fixing section (32), so that their legs extend horizontally above one another and above the top surface of the bearing plate (31). A space is provided between the two brackets (20), (22) and between the bottom bracket (22) and the bearing plate (31), by leaving a vertical distance between them. A shaft (19), (21) is supported on bearings in each of the two brackets (20), (22), which shaft extends virtually at right angles between the legs of each bracket (20), (22). The two shafts (19), (21) lie in line with each other in a direction which is virtually at right angles to the top surface of the bearing plate (31).

Two drop wires (1), (2), (3), (4) are fixed above one another on each of these shafts (19), (21), so that all drop wires (1), (2), (3), (4) are fixed rotatably in planes situated above one another.

The top drop wires (1), (3) on the respective shafts (19), (21) have ends which are bent upwards, and in which a feed-through eye (5), (7) is provided.

The bottom drop wires (2), (4) on the respective shafts (19), (21) have ends which are bent downwards, and in which a feed-through eye (6), (8) is provided. Each feed-through eye (5), (6), (7), (8) is made of ceramic material.

The weft change motion according to the invention also comprises a bearing bar (33) which is provided with means (37) for the fixing, which means are fixed on a bearing shaft (34) on the weaving machine in such a way that they are movable in the breadthwise direction. In the operational position said bearing bar (33) is disposed so that it is virtually vertical. Four fixed guide eyes (23), (24), (25), (26) are fixed above one another on said bearing bar (33).

Each of said fixed guide eyes (23), (24), (25), (26) is fixed at a height which corresponds to the height of the eye (5), (6), (7), (8) of one of the drop wires (1), (2), (3), (4).

In the operational set-up of the weft change motion four weft threads (13), (14), 15), (16) extend through respective guide eyes (23), (24), (25), (26) and through the respective feed-through eyes (5), (6), (7), (8) of the drop wires (1), (2), (3), (4), which feed-through eyes are at the corresponding height in each case.

The piston part of a double-acting pneumatic mini-cylinder (9), (10) is fixed to each drop wire (1), (2), (3), (4), the cylinder part of which is then fixed to the fixing plate (32).

Each drop wire (1), (2), (3), (4) can be rotated about its point of rotation (19), (21) by individually controlling each of these pneumatic cylinders (9), (10).

Each drop wire (1), (2), (3), (4) can be moved by these pistons into a presentation position and into a retracted position.

Each drop wire (1), (2), (3), (4) can be moved into a presentation position or into a retracted position by a stepping motor with appropriate mechanism.

In the operational set-up the weft change motion is set up in such a way that the weft threads (13), (14), which are carried along by the two drop wires (1), (2) on the top shaft (19), can be taken within the reach of the top gripper of a double-gripper weaving machine by placing said drop wires (1), (2) in the presentation position, and that the weft threads (15), (16), which are carried along by the two drop wires (3), (4) on the bottom shaft (21), can be taken within the reach of the bottom gripper by placing said drop wires (3), (4) in the presentation position.

When the respective drop wires (1), (2); (3), (4) are in the retracted position, they are beyond the reach of the respective grippers with which they interact.

Figure 2:
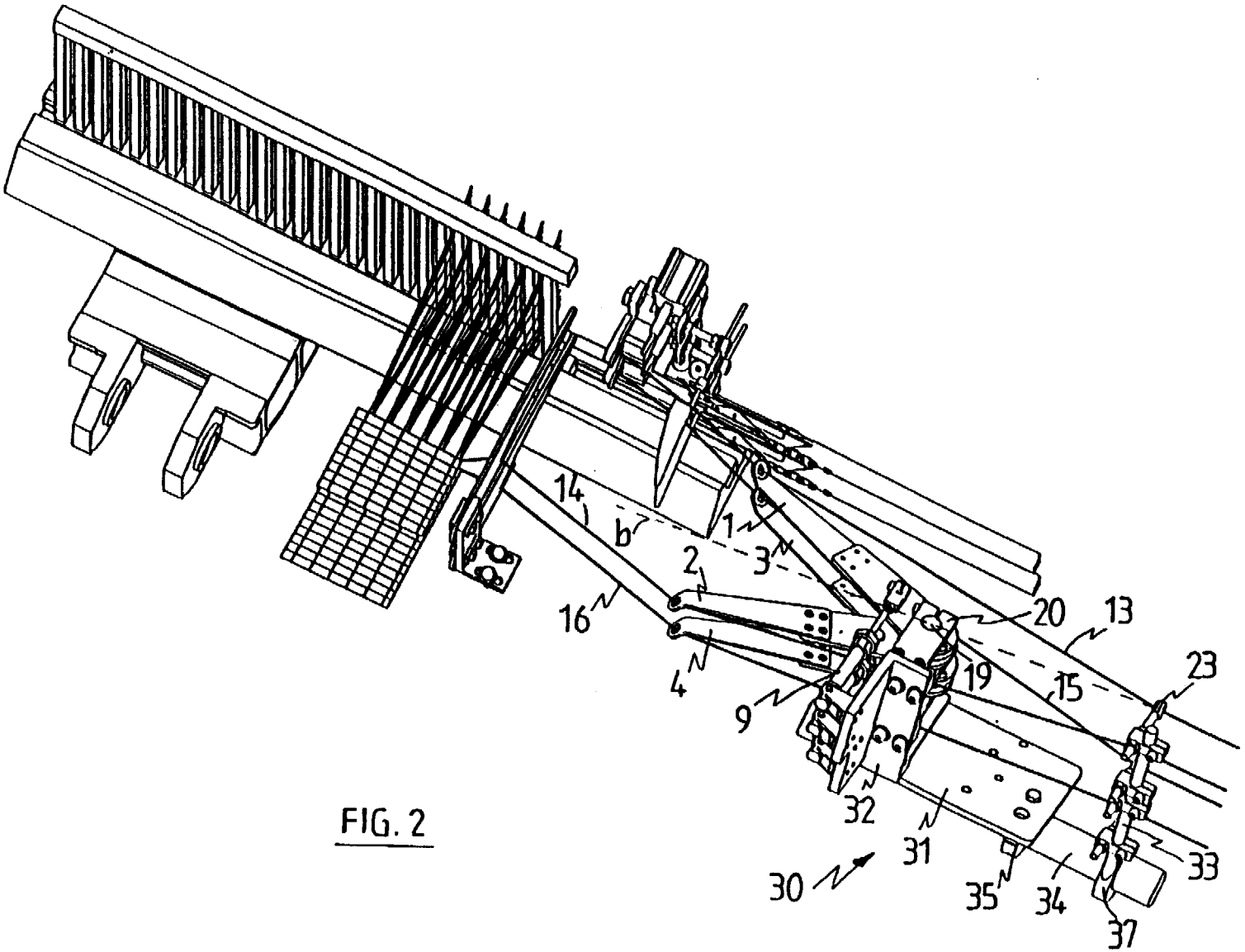
FIG. 2 shows in perspective the weft change motion of FIG. 1 and also a number of essential parts (incl. the weaving reed and the grippers) of a double-gripper weaving machine on which the weft change motion is disposed in order to interact therewith.

The positions of a weft thread corresponding to the presentation position and the retracted position of the corresponding drop wire (1), (2), (3), (4) are known as the extreme positions of said weft thread. The whole structure is designed in such a way that the shafts (19), (21) are situated virtually on the bisector (b) of the angle formed by the two extreme positions of each weft thread (13), (14), 15), (16) which extends through a drop wire eye (5), (6), (7), (8) and the corresponding guide eyes (23), (24), (25), (26). This feature is most clearly seen in FIG. 2.

The presentation position and the retracted position of each drop wire are also virtually symmetrical relative to said bisector.

The bent end of each drop wire (1), (2), (3), (4) means that:

- when the top drop wire (1), interacting with the top gripper, goes into the retracted position, the weft thread (13) is pulled by said drop wire (1) above the top surface of the top bracket (20);
- when the bottom drop wire (2), interacting with the top gripper, goes into the retracted position, the weft thread (14) is pulled by said drop wire (2) into the space between the two brackets (20), (22);
- when the top drop wire (3), interacting with the bottom gripper, goes into the retracted position, the weft thread (13) is pulled by said drop wire (3) into the space between the two brackets (20), (22); and
- when the bottom drop wire (4), interacting with the bottom gripper, goes into the retracted position, the weft thread (16) is pulled by said drop wire (4) into the space between the bottom bracket (22) and the bearing plate (31).

The bent end of the drop wires (1), (2), (3), (4) means that the friction resistance and the chance of threads becoming caught up at the level of the drop wire eyes (5), (6), (7), (8) are greatly reduced.

The set-up in pairs on common shafts (19), (21) with spaces between them and the fact that the drop wires (1), (2), (3), (4) are bent alternately upwards and downwards also permits an arrangement which minimizes the bending angle of the weft threads and ensures uniform tensioning of the weft threads in the two extreme positions.

To overcome the problem of electromagnet plungers of known weft change motion for controlling various drop wires not having sufficient changing force, the present invention has double-acting pneumatic cylinders. These cylinders can in turn be driven by a rapid-acting compressed valve, which in a preferred embodiment is operated by microprocessor control or some other programmable device.

Eliminating all these disadvantages means that the weft change motion according to this invention is particularly suitable for coarse and stiff yarns with projecting fibres.

However, this weft change motion can, of course, be used equally well for other yarns.

A weaving machine provided with a device for the insertion of a weft thread which does not have a gripper, but another means for carrying along a weft thread through the shed, can also interact with a weft change motion according to this invention.

It is clear that this weft change motion can also be extended for use with three-gripper or four-gripper weaving machines by placing additional brackets with drop wires above one another.

I claim:

1. Weft change motion for a weaving machine, comprising at least two drop wires (1), (2) which are fixed rotatably in planes lying above one another, and which are provided with a bent part having a feed-through eye (5), (6), while each drop wire (1), (2) is rotatable by control means (9), (10), to a presentation position and to a retracted position, in order to take a weft thread (13), (14) extending through the feed-through eye (5), (6) within or beyond the reach of a gripper, said weft change motion being characterized in that the drop wires (1), (2) are provided in pairs on common fixing means (19, 20); in that for each pair consisting of a top (1) and a bottom (2) drop wire a bent part of the top drop wire extends upwardly and a bent part of the bottom drop wire extends downwardly; and in that a free space is provided above and below the said fixing means (19, 20) respectively, for allowing the weft threads (13), (14) to extend unimpeded through the respective feed-through eyes (5), (6), in the retracted position of each drop wire (1), (2).

2. Weft change motion for a weaving machine, according to claim 1, characterized in that said weft change motion is provided with a fixed guide eye (23), (24) for each weft thread (13), (14), and in that the point of rotation of each drop wire (1), (2) is situated virtually on the bisector of the angle formed by the two extreme positions of a weft thread (13), (14) extending through the feed-through eye (5), (6) of said drop wire (1), (2) and through the corresponding fixed guide eye (23), (24), while said extreme positions are obtained by placing said drop wire in a presentation position and in a retracted position respectively.

3. Weft change motion for a weaving machine, according to claim 1, characterized in that the two drop wires (1), (2) are fixed rotatably on the same shaft (19) and in that said shaft (19) is supported on bearings between legs of a U-shaped bracket (20).

4. Weft change motion for a weaving machine, according to claim 3, characterized in that the feed-through eye (5), (6) is provided in the bent parts.

5. Weft change motion for a weaving machine, according to claim 1, characterized in that each drop wire (1), (2) is adapted to be controllable by a separate double-acting pneumatic cylinder (9), (10).

6. Weft change motion for a weaving machine, according to claim 1, characterized in that each drop wire (1), (2) is adapted to be controllable by a separate stepping motor and a drive mechanism.

7. Weft change motion for a weaving machine, according to claim 1, characterized in that the operation of the control means (9), (10) is determined by a microprocessor control.

8. Weft change motion for a weaving machine, according to claim 1, characterized in that said feed-through eyes are made of ceramic material set in each feed-through eye (5), (6).

* * * * *